US005557251A

United States Patent [19]

Takaoka

[11] Patent Number: 5,557,251

[45] Date of Patent: Sep. 17, 1996

[54] THERMISTOR WITH ELECTRODES FOR PREVENTING INTER-ELECTRODE MIGRATION

[75] Inventor: Yuichi Takaoka, Kyoto, Japan

[73] Assignee: Murata Manufacturing Co., Ltd., Japan

[21] Appl. No.: 218,649

[22] Filed: Mar. 28, 1994

[30] Foreign Application Priority Data

Mar. 29, 1993 [JP] Japan ..... 5-014843

[51] Int. Cl.[6] ..... H01C 7/10

[52] U.S. Cl. ..... 338/22 R; 338/225 D; 338/322; 338/324; 338/327; 338/328

[58] Field of Search ..... 338/22 R, 225 D, 338/322, 324–328, 308, 309, 314

[56] References Cited

U.S. PATENT DOCUMENTS

| | | | |
|---|---|---|---|
| 3,296,574 | 1/1967 | Tassara | 338/309 |
| 3,793,604 | 2/1974 | Duggan et al. | 338/22 R |
| 4,251,792 | 2/1981 | Ball, Jr. | 338/22 R |

FOREIGN PATENT DOCUMENTS

| | | | |
|---|---|---|---|
| 0280073 | 8/1988 | European Pat. Off. | H01C 1/142 |

*Primary Examiner*—Teresa J. Walberg
*Assistant Examiner*—Karl Easthom
*Attorney, Agent, or Firm*—Ostrolenk, Faber, Gerb & Soffen, LLP

[57] ABSTRACT

A thermistor includes a plate-like thermistor body and a first and a second electrode formed on each of the main surfaces of said plate-like thermistor body. The first electrode is formed so that its outer periphery reaches the outer peripheral edge of the thermistor and the second electrode is formed to extend from the area encircled by said first electrode onto the first electrode but not reach the outer periphery of the first electrode. The first and second electrodes are made of material which can make an ohmic-contact with the main surface of said thermistor body. The first electrode is made of the material which is hard to generate inter-electrode migration and said second electrode is made of the material which is easy to generate the inter-migration compared with the first electrode. Thus, the thermistor can prevent short-circuiting due to inter-electrode migration without deteriorating the characteristic such as a current capacity.

10 Claims, 1 Drawing Sheet

THERMISTOR WITH ELECTRODES FOR PREVENTING INTER-ELECTRODE MIGRATION

BACKGROUND OF THE INVENTION

1. Field of the Invention

The present invention relates to a thermistor such as a positive characteristic thermistor (hereinafter referred to as "PTC thermistor") and a negative characteristic thermistor (hereinafter referred to as "NTC thermistor"), and more particularly to an improvement of the thermistor having a structure in which electrodes are formed on the main surfaces of a plate-like thermistor body or element.

2. Description of the Related Art

There has been known a plate-like PTC thermistor 1 the section of which is shown in FIG. 3. The PTC thermistor 1 has such a structure that electrodes 3 and 4 are formed on both the entire surfaces of a disk-shaped thermistor body 2 made of semiconductor ceramic. In the PTC thermistor 1, the electrodes 3 and 4 must be made of material kept in ohmic contact with the thermistor body 2. Further, it is preferable that the electrodes 3 and 4 are made of the material which has the resistivity as low as possible and capable of providing a larger current capacitance.

For this reason, conventionally, the electrodes 3 and 4 were formed in such a manner that Ag or an Ag alloy is applied to the main surfaces of the thermistor body 2 by printing/baking or sputtering.

However, the electrodes 3 and 4 made of Ag or an Ag alloy has a defect that they are likely to migrate therebetween or generate inter-electrode migration. That is, while the thermistor is used, the material of the electrodes 3 and 4 migrates each other towards the electrodes 3 and 4 on the opposite sides so that short-circuiting occurs on the side of the thermistor body 2. In the worst case, the PTC thermistor was broken.

SUMMARY OF THE INVENTION

An object of the present invention is to provide a thermistor provided with an electrode structure which can surely prevent the thermistor from being destroyed due to the above-mentioned inter-electrode migration without deteriorating the characteristic such as a current capacitance.

In order to attain the above object, the thermistor according to the present invention comprises a plate-like thermistor body, and a first and a second electrode formed on each of the main surfaces of the plate-like thermistor body, the first electrode being formed so that its outer periphery reaches the outer peripheral edge of the thermistor and the second electrode being formed to extend from the area encircled by the first electrode onto the first electrode but not reach the outer periphery of the first electrode.

The first and second electrodes are made of material which can make an ohmic-contact with the main surface of the thermistor body. Further, the first electrode is made of the material which is hard to generate inter-electrode migration and the second electrode is made of the material which is easy to generate the inter-migration as compared with the first electrode.

The first electrode may be made of any material as long as it can make an ohmic-contact with the main surface of the thermistor body and is hard to generate the inter-electrode migration. The material is preferably made of e.g. Ni, Al, Cr, or an alloy of these metals.

The second electrode may be made of any material as long as it can make an ohmic-contact with the main surface of the thermistor body and is easy to generate the inter-electrode migration as compared with the material of the first electrode. The material is preferably made of e.g. Ag or Ag alloy having small resistivity.

The first and the second electrode are actually formed by coating conductive paste on the main surfaces of the thermistor body and then baking it, or by a thin-film deposition method such as electroless plating, thermal spraying or sputtering.

In the present invention, since the first electrode having a ring shape formed so as to reach the outer peripheral edge of the main surfaces of the thermistor body is made of the material which is hard to generate the inter-electrode, the inter-electrode migration is hard to generate between the first electrodes on both main surfaces.

Since the second electrode which is easy to generate the inter-electrode migration is formed so as not to reach the outer periphery of the first electrode, the surface distance between the second electrodes on both main surfaces of the thermistor body is longer than the distance between the edges of both surfaces of the thermistor body. Therefore, the migration between the second electrodes is also hard to occur.

For the above reason, even if the material which has low resistivity and can provide a large current capacity, e.g. Ag is used for the second electrode, the inter-electrode migration is hard to occur so that the thermistor with large current capacity and high reliability can be provided.

The above and other objects and features of the present invention will be more apparent from the following description taken in conjunction with the accompanying drawings.

DESCRIPTION OF THE PREFERRED EMBODIMENT

Figure 1:
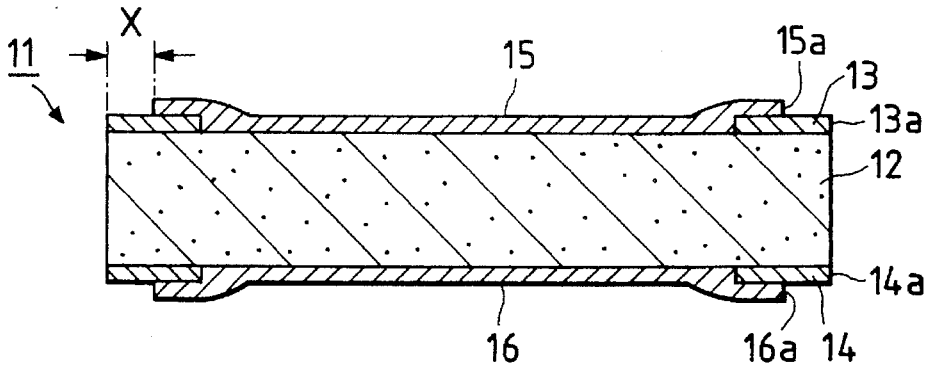
FIG. 1 shows a sectional view of the PTC according to an embodiment of the present invention.

Now referring to the drawings, an explanation will be given of an embodiment of the present invention. It should be noted that the present invention is not limited to this embodiment.

Figure 2:
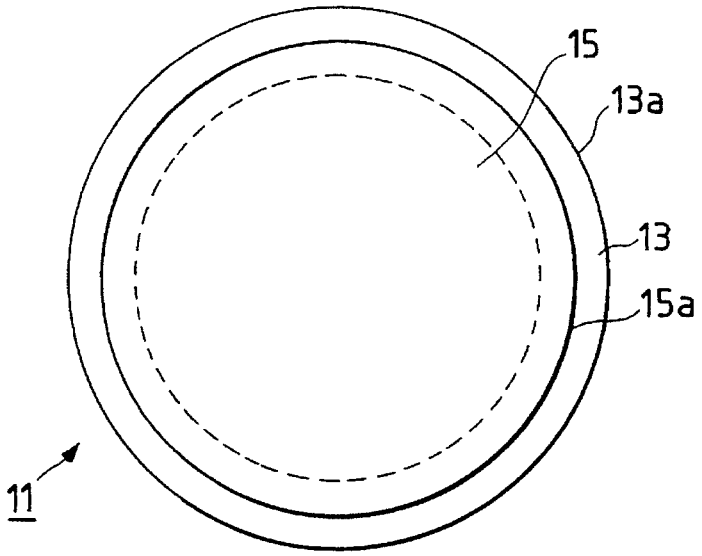
FIG. 2 shows a plan view of the PTC according to the embodiment of the present invention.
Figure 3:
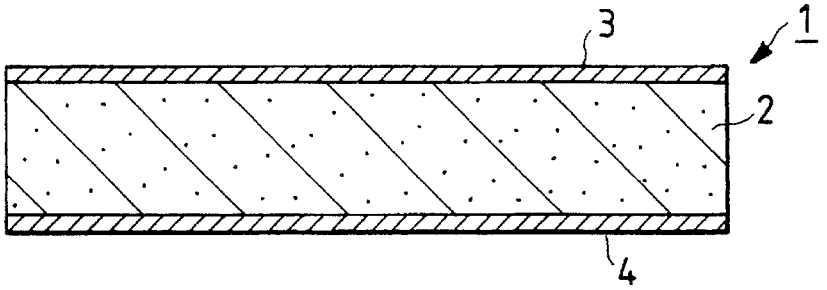
FIG. 3 PRIOR ART
FIG. 3 shows a plan view of a conventional PTC thermistor.

FIGS. 1 and 2 show a sectional and a plan view of the PTC thermistor according to one embodiment of the present invention, respectively. As seen from FIGS. 1 and 2, a PTC thermistor 11 has a thermistor body 12 made of disk-shaped semiconductor ceramic. On the top surface of the thermistor body 12, a first electrode 13 having a circular ring shape is formed, and on the bottom surface of the thermistor body 12, similarly, another first electrode 14 having a circular ring shape is formed. In this embodiment, the first electrodes 13 and 14 are formed by printing and baking Al containing conductive paste on the top and bottom surfaces so that they are kept in ohmic-contact with the both main surfaces of the thermistor body 12. The respective outer peripheries 13*a* and 14*a* of the first electrodes 13 and 14 are formed to reach the peripheral edges of both surfaces of the thermistor body 12.

In the areas encircled by the first electrodes 13 and 14, second electrodes 15 and 16 are formed so as to be brought in ohmic-contact with both main surfaces of the thermistor body 12. The second electrodes 15 and 16 are so formed that their outer peripheries 15*a* and 16*a* do not reach the respective outer peripheries 13*a* and 14*a* of the first electrodes 13 and 14. Thus, between the outer peripheries 15*a* and 16*a* of the second electrodes 15 and 16 and the side of the thermistor body 12, there is formed a gap region having a width indicated by an arrow X in FIG. 1. In this embodiment, the second electrodes 15 and 16 are made of Ag which has small resistivity but is easy to generate the inter-electrode migration. They are actually formed by printing and baking Ag-containing conductive paste. In the PTC thermistor 11 of this embodiment, the respective outer peripheries 15*a* and 16*a* of the second electrodes 15 and 16 are formed apart from the outer peripheral edges of the thermistor body 12 by a gap region indicated by an arrow X. Therefore, the inter-electrode migration is hard to generate between the second electrodes 15 and 16 on both main surfaces. In addition, the first electrodes 13 and 14 are made of Al which is hard to generate the inter-electrode migration so that the inter-electrode migration between the first electrodes 13 and 14 is hard to occur.

Further, as shown, the second electrodes 15 and 16 are formed in the entire region encircled by the first electrodes 13 and 14 so as to be kept in ohmic-contact with the thermistor body 12 and the resistivity in each of the top and bottom electrodes is also made low so that a large current capacity can be provided.

The PTC thermistor 11 according to this embodiment can be designed as a lead-equipped electronic component in such a manner that lead terminals are joined with the respective first and second electrodes 13 to 16 by soldering. Alternatively, the PTC device 11 can be designed as a lead-equipped electronic component in such a manner that it is housed in a case in a state where it is elastically sandwiched by a pair of elastic terminals.

In this embodiment, although the PTC body 12 has a disk shape of semiconductor ceramic, it may have any planar shape of square or rectangle. Further, the first electrodes 13 and 14 having a ring shape may have any closed ring including a square ring as well as a circular ring.

Although the ring-shaped first electrodes 13 and 14 has higher resistivity than that of the second electrodes 15 and 16, they are formed in limited areas of both main surfaces so that a large current capacity can be provided. The PTC thermistor according to this embodiment can be preferably used as a large current PTC thermistor having resistance of about 0.5 Ω between the electrodes.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A thermistor comprising:

a plate-like thermistor body having main surfaces; and a pair of first electrodes each formed on one of the main surfaces of said plate-like thermistor body, each said first electrode having an outer periphery which reaches an outer peripheral edge of said thermistor; and a pair of second electrodes each formed on one of the main surfaces of said plate-like thermistor body, each said second electrode extending from an area encircled by said first electrode onto said first electrode and having an outer periphery which is apart from an outer periphery of said first electrode;

wherein said first and second electrodes are both made of material which can make an ohmic-contact with the main surfaces of said thermistor body; and wherein said first electrode consists essentially of a material which is not likely to generate inter-electrode migration and said second electrode consists essentially of a material which is more likely to generate inter-electrode migration as compared with said first electrode.

2. A thermistor according to claim 1, wherein each said first electrode consists essentially of metal selected from the group consisting of Ni, Al, Cr and an alloy of these metals.

3. A thermistor according to claim 1, wherein each said second electrode consists essentially of Ag or Ag alloy.

4. A thermistor according to claim 1, wherein each said first electrode is of a ring shape.

5. A thermistor according to claim 1, wherein said second electrodes have lower resistivity than said first electrodes.

6. A thermistor according to claim 2, wherein each said second electrode consists essentially of Ag or Ag alloy.

7. A thermistor according to claim 2, wherein said second electrodes have lower resistivity than said first electrodes.

8. A thermistor according to claim 3, wherein said second electrodes have lower resistivity than said first electrodes.

9. A thermistor according to claim 4, wherein said second electrodes have lower resistivity than said first electrodes.

10. A thermistor according to claim 6, wherein said second electrodes have lower resistivity than said first electrodes.

* * * * *